US007086449B2

(12) United States Patent
Zajber et al.

(10) Patent No.: US 7,086,449 B2
(45) Date of Patent: Aug. 8, 2006

(54) DEVICE FOR CONTINUOUSLY CASTING METALS, ESPECIALLY STEEL

(75) Inventors: Adolf Gustav Zajber, Langenfeld (DE); Thomas Fest, Duisburg (DE)

(73) Assignee: SMS Demag Aktiengesellschaft, Dusseldorf (DE)

( * ) Notice: Subject to any disclaimer, the term of this patent is extended or adjusted under 35 U.S.C. 154(b) by 96 days.

(21) Appl. No.: 10/450,750

(22) PCT Filed: Dec. 1, 2001

(86) PCT No.: PCT/EP01/14067

§ 371 (c)(1),
(2), (4) Date: Jul. 21, 2003

(87) PCT Pub. No.: WO02/47847

PCT Pub. Date: Jun. 20, 2002

(65) Prior Publication Data

US 2004/0050528 A1 Mar. 18, 2004

(30) Foreign Application Priority Data

Dec. 14, 2000 (DE) ..... 100 62 440

(51) Int. Cl.
*B22D 11/04* (2006.01)
*B22D 11/051* (2006.01)

(52) U.S. Cl. ..... 164/418; 164/415; 164/416

(58) Field of Classification Search ..... 164/416, 164/478, 418, 459, 415, 474–475
See application file for complete search history.

(56) References Cited

U.S. PATENT DOCUMENTS

| | | | | |
|---|---|---|---|---|
| 3,528,483 | A | 9/1970 | Mallener | |
| 3,565,155 | A | 2/1971 | Vertesi | |
| 4,173,251 | A * | 11/1979 | Scheinecker | 164/436 |
| 4,483,385 | A | 11/1984 | Kurzinski | |
| 4,669,525 | A | 6/1987 | Kurzinski | |
| 4,957,156 | A * | 9/1990 | Mayrhofer | 164/504 |
| 6,079,479 | A * | 6/2000 | Osada et al. | 164/428 |
| 6,138,743 | A * | 10/2000 | Zajber et al. | 164/416 |
| 6,298,905 | B1 * | 10/2001 | Kaell et al. | 164/416 |

FOREIGN PATENT DOCUMENTS

EP 1029616 * 8/2000

* cited by examiner

*Primary Examiner*—Kuang Y. Lin
(74) *Attorney, Agent, or Firm*—Andrew Wilford

(57) ABSTRACT

An apparatus for the continuous casting of metals, especially of steel, is equipped with a base frame (2) carrying a continuous casting mold (1) and an oscillating device (3) disposed on the base frame (2) and with a foot roller frame (4) disposed on the foot end (1*a*) of the continuous casting mold (1). In order to obtain better protection for the mold region and components disposed downstream thereof, it is proposed that the continuous casting mold (1) together with an oscillation frame (3*b*) and an oscillating drive (3*a*) engaging the oscillating frame (3*b*) be arranged in an upwardly and laterally closed housing (5) and that the foot roller frame (4) fastened on the continuous casting mold (1) extends through a laterally shielding lower housing (6).

9 Claims, 4 Drawing Sheets

DEVICE FOR CONTINUOUSLY CASTING METALS, ESPECIALLY STEEL

CROSS REFERENCE TO RELATED APPLICATIONS

This application is a national stage of PCT/EP01/14067 filed 1 Dec. 2001 and based upon German National application 100 62 440.5 of 14 Dec. 2000 under the International Convention.

FIELD OF THE INVENTION

The invention relates to a device for the continuous casting of metal, especially steel, having a base frame carrying the continuous casting mold and an oscillating device disposed on the base frame, and a foot roller frame disposed at the foot end of the continuous casting mold.

BACKGROUND OF THE INVENTION

In the continuous casting of steel, because of the use of casting powder which mixes with spray cooling water, hydrofluoric acid develops. With prior constructions of continuous casting plants, every machine part is attacked by this aggressive medium. Especially sensitive components like, for example, resonance molds in which leaf springs serve for oscillation of the continuous casting mold, suffer from attack by this acid.

It has not been recognized as possible heretofore with earlier continuous casting, especially with small strand cross sectional dimensions, to completely avoid strand breakthrough. The breakthrough occurs through the thinner strand shell directly below the continuous casting mold. As a consequence the liquid metal like, for example, molten steel, can flow out over the plant and the impacted machine parts are thereby damaged. In these damaged regions the leaf spring stacks of resonance molds are also to be found.

OBJECT OF THE INVENTION

The invention has as its object to provide better protection of the mold region and components disposed downstream therefrom.

SUMMARY OF THE INVENTION

This object is achieved according to the invention in that the continuous casting mold together with an oscillating frame and an oscillation drive engaged with the oscillating frame are disposed in an upwardly and laterally closed housing and in that the foot roller frame fastened on the continuous casting mold extends through a lateral shielding lower housing. As a result, the mold region is significantly better protected than heretofore and in the case of unavoidable breakthroughs, the foot roller frame is also better protected. This kind of housing of the components is especially advantageous in the case of continuous casting molds which are oscillated in the resonance method for the casting of billet strands for structural shapes or sections because these have a stationary base frame.

According to a refinement it is provided that a housing cover plate has an opening for the upper part of the continuous casting mold and that each of the lateral housing walls is secured on the stationary base frame of the continuous casting apparatus. This sealing at the molten metal inlet of the continuous casting mold without limiting the oscillation movement.

According to further features a cover which oscillates together with the mold is seated on a mold insert and/or a water box and extends through the opening. As a consequence, the covering can be held comparatively low and flat.

An improvement according to the invention resides in that the base frame together with the housing cover plate and the lateral wall forms a transportable unit which can rest upon the foundation or a steel frame. This unit can be easily handled by a winch and can be largely assembled and equipped in its finished state when delivered.

According to further features, the lower housing can be fixed on the bottom plate of the base frame. As a result, between the continuous casting mold and the lower housing a seal can be formed which allows the movement of the continuous casting mold during the oscillation.

According to other features the lower housing forms a labyrinth seal which surrounds the mold foot end with play to provide the seal.

The arrangement, maintenance and mounting of the foot roller frame is, in addition, improved in that the lower housing is configured with somewhat of a bell shape with stepped segments of downwardly increasing size. A smaller diameter of the continuous casting mold can thus be utilized for the labyrinth seal.

For the arrangement and configuration of the oscillating device there are several possible variants. One of these variants resides in that the oscillating device is provided with a hydraulic or electric drive motor which is disposed on the bottom plate of the base frame. The drive motor thus also enjoys the protection of the housing and is shielded from breakthroughs below the continuous casting mold.

Another variant of the drive arrangement resides in that the oscillating device is provided with a hydraulic or electrical drive motor located beneath the bottom plate of the base frame and which is surrounded by a protective housing. An additional protection against high radiation temperatures of the cast strand is provided in that the protective housing for the hydraulic or electrical drive motor is water cooled.

Further advantages are obtained when the space below the housing cover plate and between the lateral housing walls and above the lower housing receives an electromagnetic agitating coil. The advantages of the housing are thus also provided for the agitating coil.

This arrangement is also of advantage when the electromagnetic agitating coil in this space is height adjustable.

BRIEF DESCRIPTION OF THE DRAWING

In the drawing an embodiment of the invention has been shown which is described in greater detail hereinafter.

In the drawing.

SPECIFIC DESCRIPTION

Figure 1:
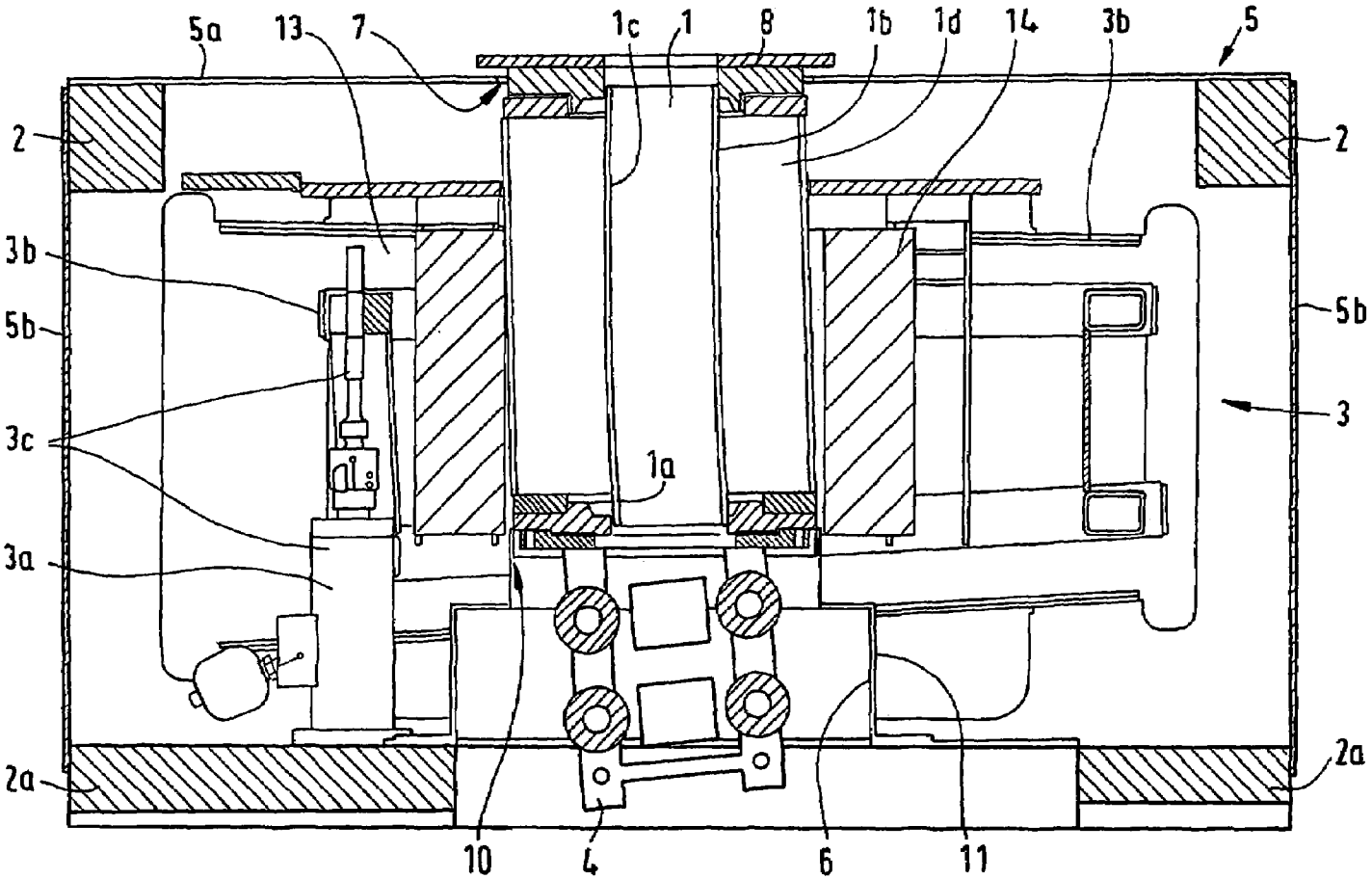
FIG. 1 is a vertical section through the entire assembly of a housing with a base frame and continuous casting mold as well as the oscillating uni.

The device for continuously casting metal, especially steel, comprises a base frame 2 carrying the continuous casting mold 1 and an oscillating unit 3 arranged on the base frame, whereby at the foot end 1*a* of the continuous casting mold 1, a foot roller frame 4 is secured (FIG. 1).

The continuous casting mold is, together with an oscillating frame 3*b* and an oscillating drive 3*a* engaged with the oscillating frame 3*b*, arranged in an upwardly and laterally closed housing 5. The foot roller frame 4 disposed on the continuous casting mold 1 extends through a laterally shielding lower housing 6.

The housing 5 is closed by means of a housing cover plate 5*a* which has an opening 7 for the upper part 1*b* of the continuous casting mold and is completed by respective housing walls 5*b* on each side on the fixed base frame 2 of the continuous casting device.

A cover 8, which oscillates together with the mold, passes through the opening 7 and is seated on the mold insert 1*c* and/or on a water box 1*d* and forms a protection at the casting inlet side.

Figure 2:
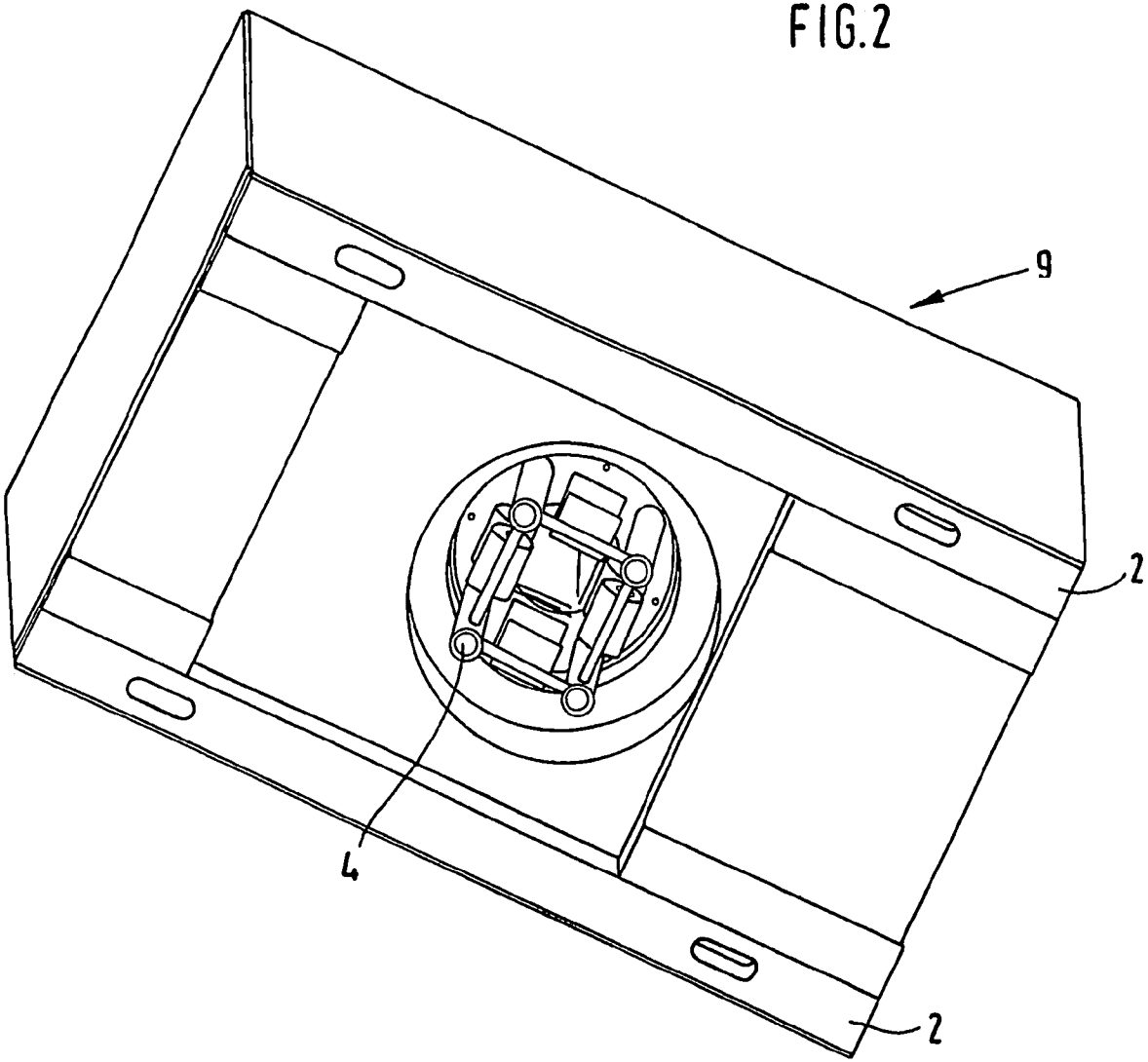
FIG. 2 is a perspective view from below toward the housing with the foot roller fram.
Figure 3:
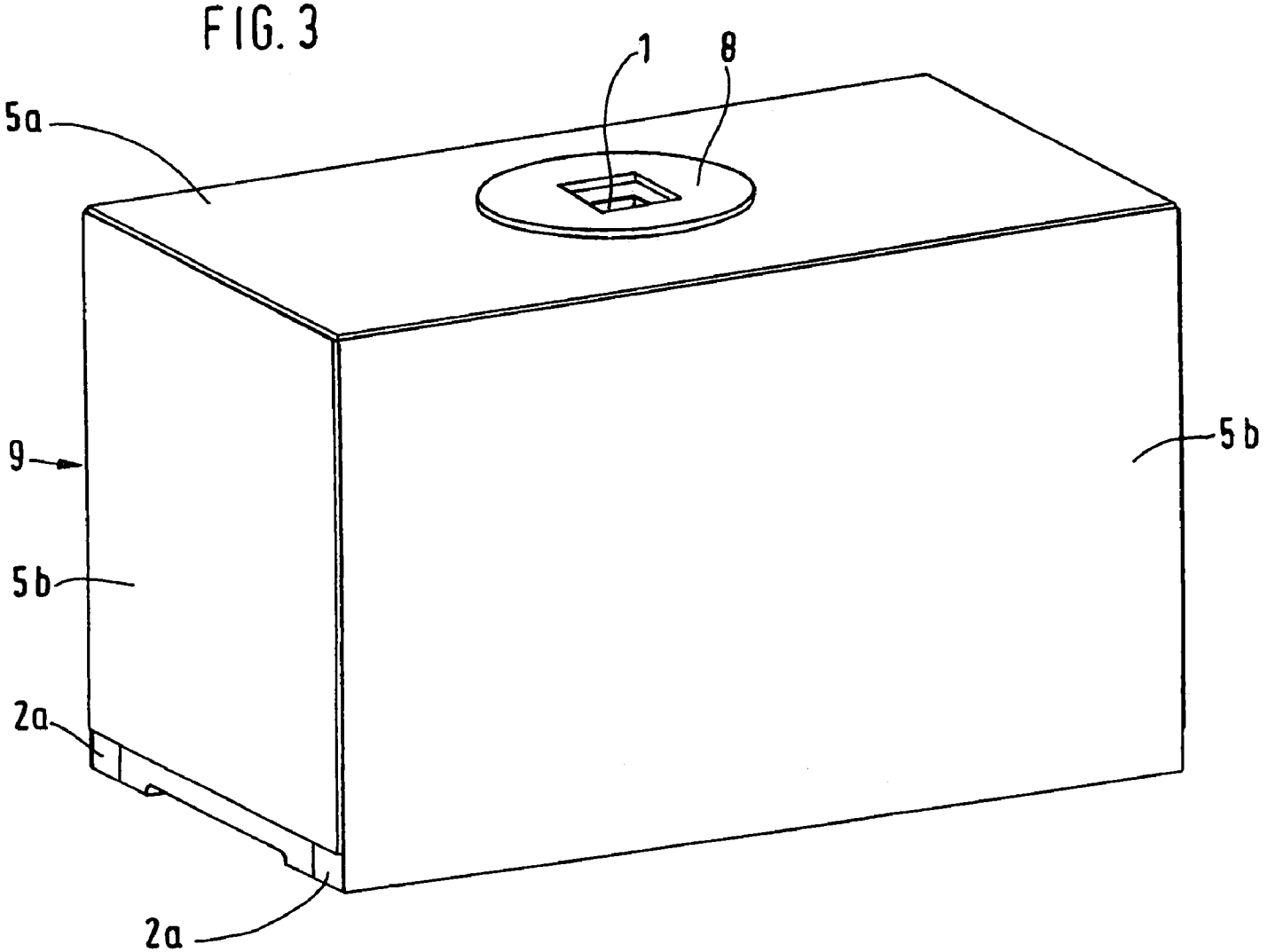
FIG. 3 is a perspective view of the upstanding housing.

The base frame 2 with the housing cover plate 5*a* and the two lateral and the front and rear housing walls 5*b*, form a unit 9 (FIGS. 2 and 3) which can be supported on the foundation or on a steel frame.

The lower housing 6 is fixed on the bottom plate 2*a* of the base frame 2. In this manner the lower housing 6 forms a labyrinth seal surrounding the foot end 1*a* of the continuous casting mold 1. The lower housing is formed somewhat as bell-shaped and has one or more step segments 11 increasing in size downwardly.

The oscillating device 3 is equipped with a hydraulic (or electric) drive motor 3*c* and is mounted on the base plate 2*a* of the base frame 2.

Figure 4:
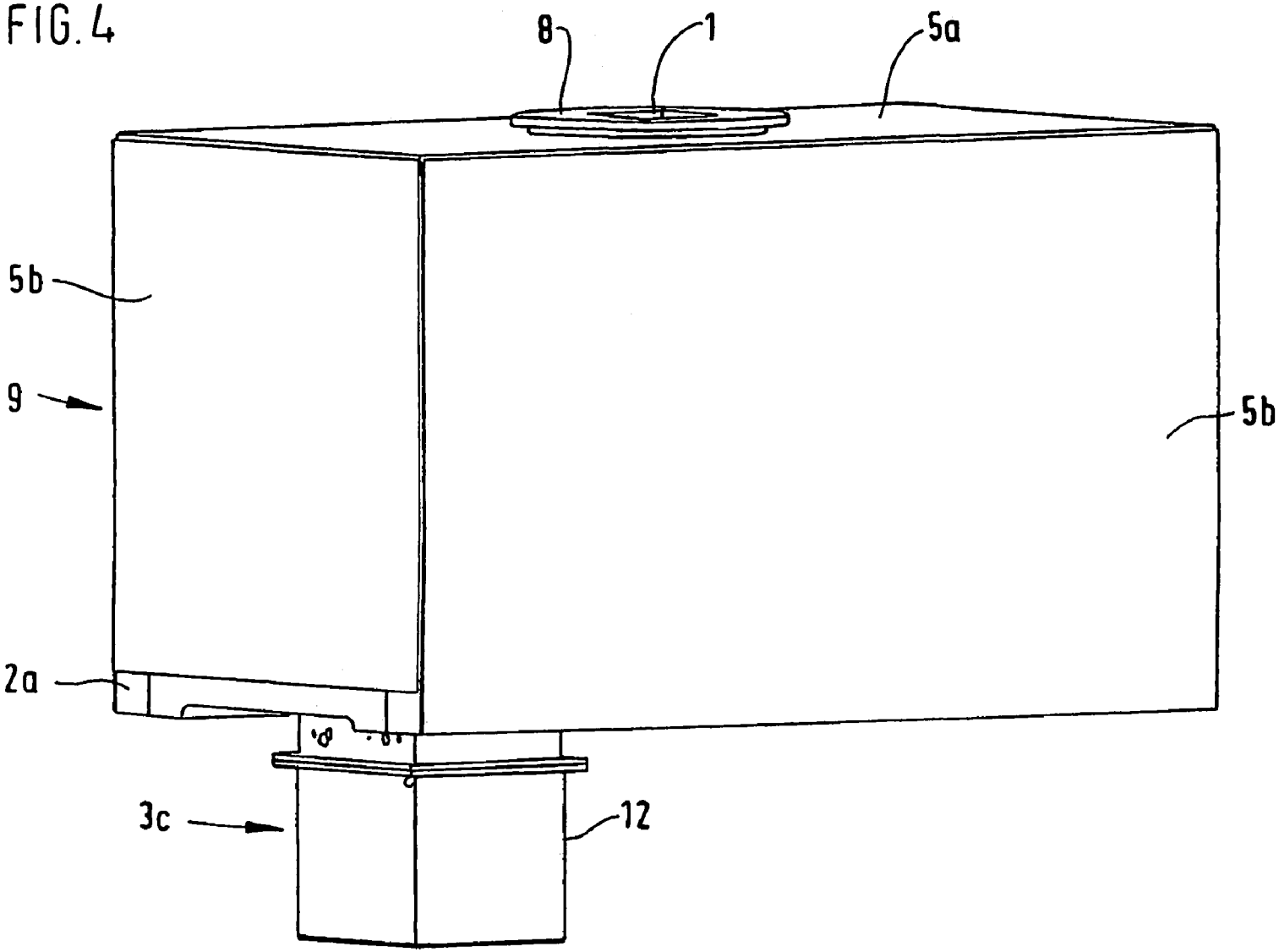
FIG. 4 is a perspective view of the housing with the drive motor for the oscillating device arranged externally thereof.

The oscillating device 3 comprises, according to an alternative embodiment of FIG. 4, an electric (or hydraulic) drive motor 3*c* below the bottom plate 2*a* of the base frame 2 and which is surrounded by a protective housing 12. The protective housing is provided for shielding the motor against the high heat radiation of the cast strand with a water cooling, for example, in the protective housing walls.

In the space 13 below the housing cover plate 5*a* and between the lateral housing walls 5*b* and above the lower housing 6, an electromagnetic melt agitating coil 14 is provided which thus also lies within the housing 5. For that purpose the space 13 is so dimensioned that the electromagnetic agitating coil 14 can be located at a level which can be selected based upon the metallurgical effects to be obtained thereby and can be adjustable in height.

The invention claimed is:

1. An apparatus for the continuous casting of metal, comprising:

a base frame;

a continuous casting mold mounted on the base frame;

an oscillating unit disposed on the base frame and interposed between the base frame and the continuous casting mold, said oscillating unit comprising an oscillating frame and an oscillating drive engaged with the oscillating frame;

an upwardly and laterally closed housing surrounding in common said continuous casting mold, said oscillating frame and said oscillating drive;

a foot roller frame fastened on a bottom of the continuous casting mold; and a lower housing laterally shielding said foot roller frame, said first roller frame extending through said laterally shielding lower housing, said laterally closed housing including a housing cover plate having an opening for an upper part of the continuous casting mold and respective lateral housing walls fastened on the base frame and extending from the cover plate to the base frame, the lower housing being fixed on a bottom plate of the base frame and forming a labyrinth seal which surrounds a foot of the mold with clearance.

2. The apparatus according to claim 1 wherein a cover, passing through said opening, is seated on a mold insert and/or a water box, whereby the cover oscillates with the continuous casting mold.

3. The apparatus according to claim 1 wherein the base frame together with the housing cover plate and the lateral housing walls form a transportable unit which can be supported on the foundation or a steel frame.

4. The apparatus according to claim 1 wherein the lower housing is configured so as to be bell shaped with stepped segments which are of increasing size downwardly.

5. The apparatus according to claim 1 wherein the oscillating unit is provided with a hydraulic or electrical drive motor which is disposed on a bottom plate of the base frame.

6. The apparatus according to claim 1 wherein the oscillating unit is provided with a hydraulic or electrical drive motor which is located beneath a bottom plate of the base frame and is surrounded by a protective housing.

7. The apparatus according to claim 6 wherein the protective housing is provided with a water cooling for the hydraulic or electrical drive motor.

8. The apparatus according to claim 1 wherein an electromagnetic agitating coil is arranged in a space beneath the housing cover plate and between the lateral housing walls and above the lower housing.

9. The apparatus according to claim 8 wherein the electromagnetic agitating coil is so arranged as to be of adjustable height in said space.

* * * * *